United States Patent [19]

Braun

[11] Patent Number: 5,071,277

[45] Date of Patent: Dec. 10, 1991

[54] DUO-STABLE CONFIGURATED CONTAINER WITH CAP, WAND AND APPLICATOR ASSEMBLY

[75] Inventor: Morris Braun, Chicago, Ill.

[73] Assignee: W. Braun Company, Chicago, Ill.

[21] Appl. No.: 550,876

[22] Filed: Jul. 11, 1990

[51] Int. Cl.[5] ..... A46B 11/00

[52] U.S. Cl. ..... 401/126; 220/631; 401/129

[58] Field of Search ..... 401/126-130; 206/209, 15.2, 15.3; 220/603, 631; 222/463

[56] References Cited

U.S. PATENT DOCUMENTS

| | | | |
|---|---|---|---|
| 279,915 | 6/1883 | Clark | 220/631 X |
| 957,829 | 5/1910 | White et al. | 222/463 X |
| 1,193,433 | 8/1916 | Searcy | 401/130 X |
| 1,301,694 | 4/1919 | Healy | 220/631 |
| 2,056,751 | 10/1936 | von Till | 401/128 |
| 2,248,011 | 7/1941 | Neuschaefer | 401/128 X |
| 2,271,746 | 2/1942 | Schmalz | 401/128 |
| 2,550,586 | 4/1951 | Nardone | 401/129 |
| 2,793,788 | 5/1957 | Lysne | 220/631 |
| 3,185,291 | 5/1965 | Lerner | 206/209 |
| 3,805,995 | 4/1974 | Lebel et al. | 220/603 |
| 4,850,727 | 7/1989 | Gueret | 401/126 |

FOREIGN PATENT DOCUMENTS

| | | | |
|---|---|---|---|
| 403184 | 6/1966 | Switzerland | 401/129 |

*Primary Examiner*—Steven A. Bratlie
*Attorney, Agent, or Firm*—Michael G. Berkman

[57] ABSTRACT

A container and a cooperating cap, applicator and assembly for use in storing, retrieving, and in applying a fluid-like cosmetic material, and for other uses. The container is characterized in that it is conveniently positioned to assume each of two different, physically-stable, orientational attitudes or modes. In a first mode, the container stands upright, in a conventional manner. In its second mode, the container assumes a tilted or angular position so that the wand-manipulated applicator may conveniently be withdrawn and reinserted at a comfortable, corresponding use angle. Any need to exercise an inherently more awkward straight-up manipulation of the wand is obviated. The duo-stable capability feature is imparted to the container by providing a container base or floor with two distinct sectors which are angled with respect to one another. The wand assembly comprises a plurality of inter-coupled components which conveniently includes an elongate probe or applicator and a surmounting, integrally-formed, disc-like sealing flange. A handle coupled to the probe through a connecting boss extends upwardly from the probe and an interiorly threaded bushing is sleeved over and abuts a base rim of the handle, coupling the handle and probe to the container in fluid-sealing engagement.

7 Claims, 2 Drawing Sheets

DUO-STABLE CONFIGURATED CONTAINER WITH CAP, WAND AND APPLICATOR ASSEMBLY

BACKGROUND OF THE INVENTION

The present invention relates to a container for use in the storing, retrieval and in the application of a fluid-like cosmetic material or the like, and in which the material is conveniently applied by means of a wand, brush or other spreading medium. More particularly, the invention is directed to a container characterized in that it is conveniently positionable to assume each of two different, physically-stable orientational attitudes, or modes, including a conventional upright standing mode and a second mode in which the container assumes a stable tilted or angular position, the latter facilitating the withdrawal and the reinsertion of the elongated applicator into the container and its withdrawal during intended use.

Containers or storage receptacles for use with fluid and fluid-like products have assumed many structural configurations and designs. In such containers, and particularly with respect to containers of the type used to store and/or to apply nail polish compositions, medicinals, stenographic coatings and mascara formulations, the container is stored as well as used in an upright position, it being necessary most carefully to insert the probe-like applicator vertically downwardly through the mouth of the container to reach the composition stored. The probe must then be carefully drawn upwardly without excessive lateral movement so as to obviate upsetting the container. The procedure described is inherently awkward calling as it does for more than casual coordination between visual gauging and mechanical motion. Proper manipulation calls for the exercise of good depth perception, the avoidance of parallax problems and coordination, not only to carry out the necessary manipulative operation, but to avoid upsetting the container itself.

The prior art is also replete with storage receptacles, or containers or bottles, which are used in conjunction with applicator probes and in which the probe itself is secured to the container cap or closure. A common and widespread serious problem with such structures has been the difficulty of insuring positive and effective sealing of the container when the combination applicator and cap is affixed in place as a closure for the container. Many and varied types of physical arrangements and designs have been proposed, but none of these has solved all of the problems experienced. It is, therefore, a principal aim of the present invention to provide a storage container or bottle for cosmetic and related uses and equipped with a combination applicator and closure cap assembly, and in which the ease of use is enhanced and a fluid tight seal of the container, during non-use, is insured.

SUMMARY OF THE INVENTION

It is a principal feature of the container of the present invention that the container itself is capable of assuming each of two different, physically stable orientational attitudes or modes. In accordance with the practice of the invention, the unique capability is achieved by fabricating the container with a floor or supporting base which includes two intersecting, angled sectors which extend in two corresponding intersecting planes.

A related feature of the invention is that a first of the base sectors lies in a plane which is normal of a principal longitudinal axis of the container itself to establish a stable standby or storage mode.

Yet another feature of the duo-stable container of the invention is that a second of the base sectors is angularly oriented with respect to a principal longitudinal axis of the body of the container so as to maintain a center of gravity of the container at a locus which overlies the second sector when the container rests on that sector, thereby to insure that when the container is tilted, in a use mode, it is in a mechanically stable attitude.

It is an important feature of the invention that the handle, the fluid applicator and the receptacle closure cap are employed as a unitary assembly but are composed of separate and distinct mechanical parts, thereby contributing materially to ease and precision in fabricating, such as in plastics molding operations.

In a preferred embodiment of the invention the handle or wand component is fastened to the depending applicator probe by means of a wand-carried boss which is integrally formed with the wand and extends downwardly therefrom to couple into a cooperating cavity or well formed coaxially in an upper zone of the probe itself, mechanical intercoupling elements projecting from the boss being received in cooperating recesses formed in the bounding walls of the cavity in the probe.

In a preferred embodiment of the invention there is provided a bushing or sleeve which is threaded internally for threadedly mating engagement with threads integrally formed on the outer neck portion of the container itself. The sleeve is formed with a generally cylindrical coaxial opening the bounding walls of which receive the wand or handle of the applicator upwardly therethrough in sealing engagement therewith.

A related feature of the invention is that a shoulder of the container-engaging bushing bears downwardly upon a laterally extending flange of the wand to urge the wand and the probe attached thereto in a downward direction as the sleeve is threadedly advanced onto the threaded neck of the container.

An important feature of the invention is that the probe is provided at its upper end zone with a laterally extending annular wing, the latter engaging and effecting a positive, fluid-tight seal with the neck of the bottle at an interior upper edge thereof as the closure is effected.

A related feature of the invention is that the laterally extending annular wing carried by the probe is sufficiently resilient to insure a positive live seal between the wing and the abutting contacting edge of the container neck at its mouth.

A related feature of the invention is that as the sleeve-like closure component is advanced threadedly onto the threaded neck of the container, the annular flange at a lower end of the principal body portion of the wand or handle bears upon and stressingly stabilizes the flexible annular wing carried by the probe, thus insuring that the seal effected is positive and resiliently viable.

A feature of the invention contributing to its versatility and adaptability is that any of a series of selectable probe assemblies each having its own specific applicator end may conveniently be secured to the wand to interlock therewith.

Yet another advantage of the container of the assembly is that full immersion of the applicator probe is conveniently effected, even though the container contains less than its full volume of product.

A feature of the invention contributing to insuring a fluid tight seal is the avoidance of interference between two flat surfaces at a component sealing interface.

A related advantageous feature of the invention is that the seal effected between the applicator head and the finish land of the bottle or container is one with flexing action, insuring an effective, positive seal.

An important advantage of the container and applicator assembly of the invention is that the full finish opening is available and unobstructed to facilitate the insertion of the applicator probe element.

Other and further objects, features, and advantages of the assembly of the invention will be evident from the following description considered in conjunction with the drawings.

DESCRIPTION OF THE ILLUSTRATED EMBODIMENT

The aims and objects of the invention are achieved by providing in a storage and dispensing container and applicator assembly a container which is formed with a base defining two sectors angled with respect to one another. The container is capable of assuming, selectively, either an upright or storage mode or an angled use mode, each mechanically stable. It is a characteristic of the selectively positionable container that it facilitates the insertion and withdrawal of a hand held probe and applicator at an angle and thus avoids the need to insert and withdraw the probe in a more awkward, straight up and down hand movement. The versatility and adaptability of the wand and probe assembly is insured by providing simple mechanical interlock means by which a particular, selectable probe is securely fastened at the base of the wand itself, thus establishing utility of the assembly in diverse applications. The same mechanical arrangement enables one to use any of a group of selectable wands to establish any desired motif or color combination. A bushing-like sleeve threaded internally for attachment to a threaded neck of the container is slidable over to grip and to urge the wand and probe assembly in fluid-sealing securement to the container itself.

A related feature of the invention is the provision of a flexible annular wing integrally formed with the probe and disposed to bear upon and seal the open neck of the container at an inner annular edge zone thereof, thereby to establish a resilient and positive fluid-tight seal. A flange-like collar at the base of the principal body portion of the wand is oriented to bear upon and resiliently to stress or tension the flexible annular wing of the probe, further to guarantee a positive, effective seal of the wand and probe assembly with the bottle or container.

Figure 1:
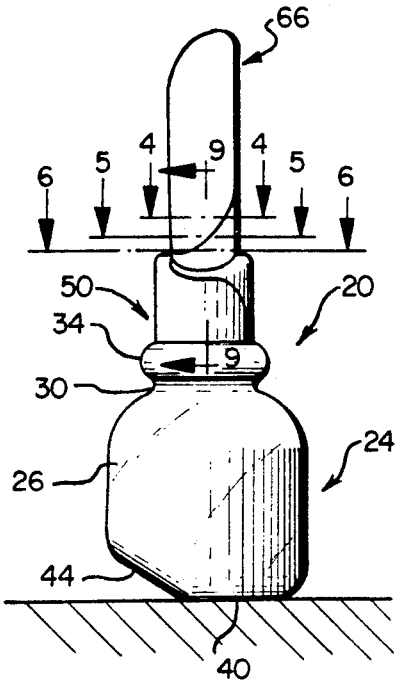
FIG. 1 is a side elevational view of a container-dispenser bottle, according to the present invention, with the combination closure and applicator wand in place and showing the bottle in its non-use or upright storage mode.
Figure 2:
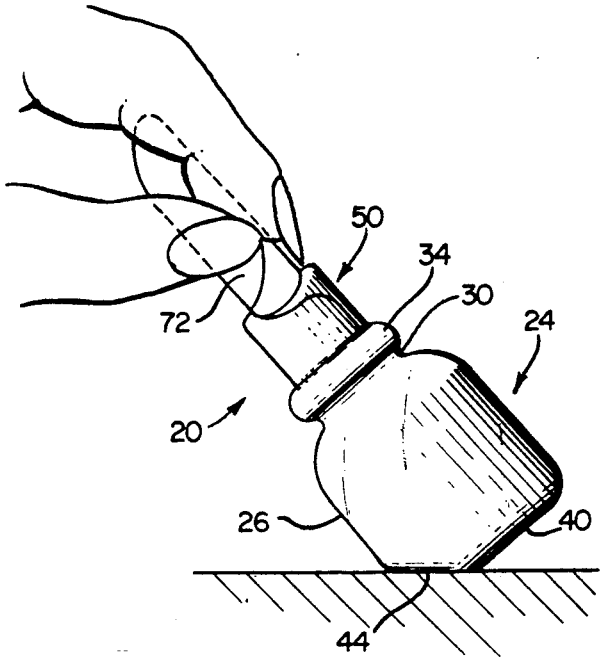
FIG. 2 is a side elevational view of the bottle of the invention in an in-use, tilted disposition and indicating, schematically, the manner of use.
Figure 3:
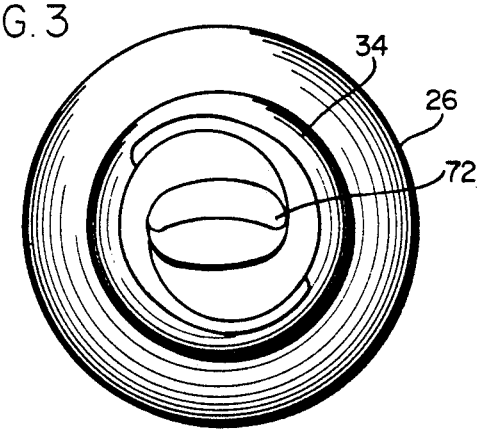
FIG. 3 is a top plan view of the container of the invention.
Figure 4:
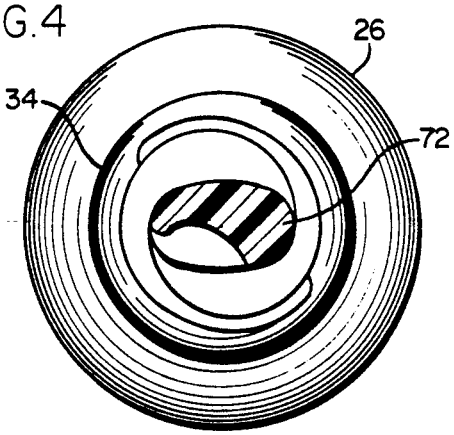
FIGS. 4–6 are cross-sectional views taken, respectively, substantially on the lines 4—4, 5—5 and 6—6 of FIG. 1, and showing the thread structures and configurations of the closure wand.
Figure 5:
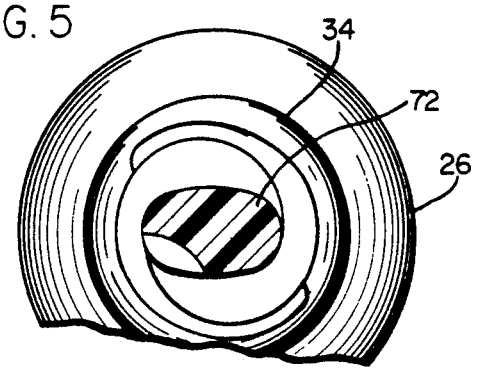
Figure 6:
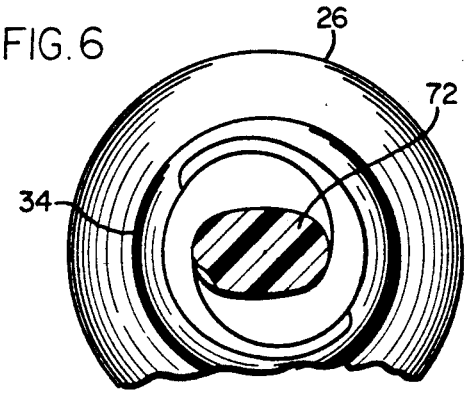
Figure 7:
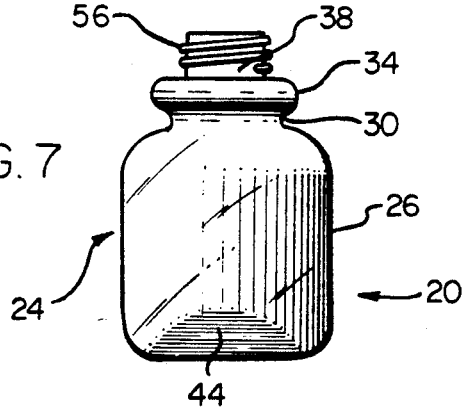
FIG. 7 is a front elevational view of the duo-based container body of the invention.

Referring now to the drawings, there is shown one preferred embodiment of the duo stable container and cooperating handle, cap and applicator assembly of the invention provided for illustrative purposes and not to be construed in any limiting sense. The combination container and applicator 20, as shown in FIGS. 1, 2, 7 and 8 consists of a container 24 having a generally cylindrical body 26 and a constricted upper zonal area 30 flared outwardly and terminating in a toroidal ring, the latter being surmounted by a threaded neck 38 (FIG. 7). The base or bottom wall of the container 24 includes a first sector 40 which lies in a plane normal to a principal longitudinal axis of the container 20. A second portion of the base or floor constitutes a sector 44 which is angled to extend upwardly from the base sector 40. The structure described makes it possible for the container to assume, selectively, each of two distinct positional modes. In a first of the modes the container stands "upright" on the first base segment 40 (FIG. 1). In a second mode the container assembly rests on the second base segment 44 in an angular disposition (FIG. 2). It is an important physical attribute or characteristic of the container that each of the two attitudes it assumes is a mechanically stable one.

Figure 8:
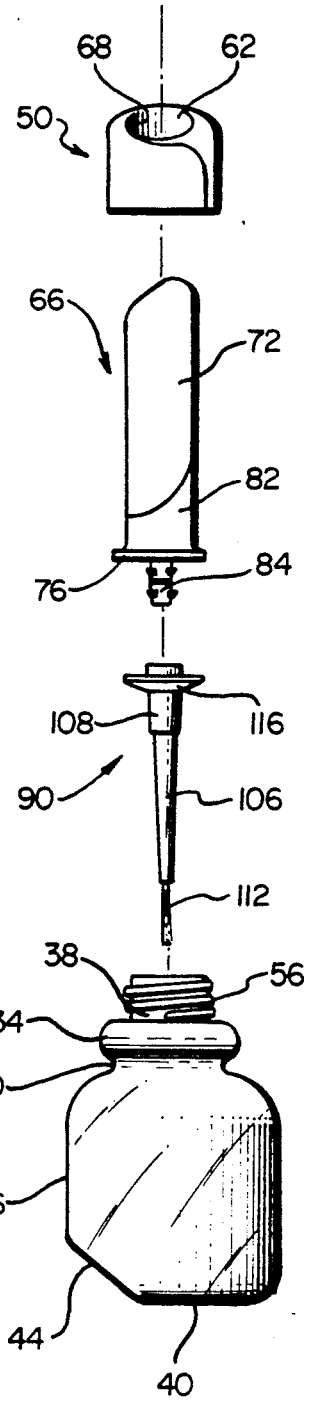
FIG. 8 is an exploded view showing the bottle and the applicator wand assembly, in accordance with the invention.

Referring now to FIG. 8, there is shown one preferred embodiment of a series of cooperating components which define, in combination, a handle, an applicator probe, and a closure for the container 24. As illustrated, the several separate components include a sleeve like bushing 50 formed with interior threads 54 for mating engagement with cooperating threads 56 formed on the neck 38 of the bottle 24. The bushing 50 is formed with a coaxial channel or through opening 62 for insertion therethrough of a handle-like shaft or wand 66 which effects a contiguous engagement with a cylindrical wall 68 bounding the channel 62 of the bushing-like cap 50. In a preferred specific embodiment of the wand like handle 66, a principal length is cut away or contoured 72 to provide an aesthetically pleasing overall appearance of the wand 66. As shown in FIG. 8, the wand terminates at its lower extremity in an outwardly directed flange 76 which abuts an internal shoulder 78 when the bushing like closure element 50 is slidably advanced downwardly onto a base section 82 of the wand 66, as shown in FIG. 9.

Figure 10:
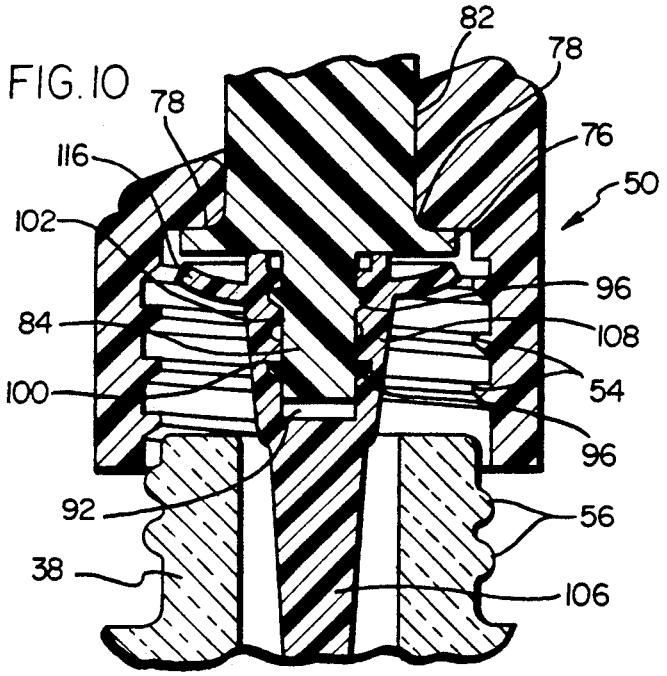
FIG. 10 is a view similar to FIG. 9, but showing the combination cap and wand assembly threadedly elevated for withdrawal of the depending applicator probe from the container.
Figure 9:
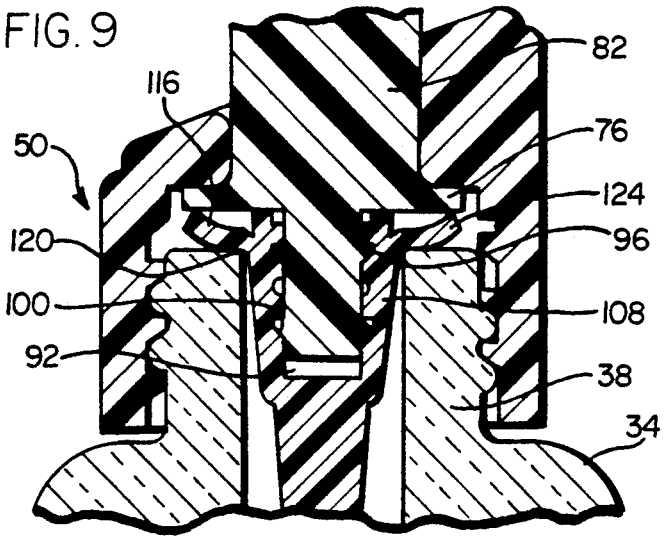
FIG. 9 is an enlarged, fragmentary, cross-sectional view taken substantially on the lines 9—9 of FIG. 1, showing the wand assembly threaded onto the neck of the container in fluid-sealing engagement therewith.

As shown in FIGS. 8–10, the wand 66 is integrally formed at its lower end, to extend beyond the flange 76, with a boss or plug 84 coaxial with the handle-like wand 72. A probe-like applicator 90 is formed at its upper end with a socket 92 opening upwardly for matingly receiving the handle-carried boss 84 therewithin. In the specific embodiment of the invention illustrated, the boss or plug 84 is formed with radially extending projections 96 which invade and lock within cooperating recesses 100 formed in the bounding wall 102 of the socket 84.

The probe-applicator includes an elongate tapered shaft depending from an upper body 108 and terminating at its lower end in an applicator 112 of brush fibers or the like. Extending radially outward of and integrally formed with the surmounting body 108 is an annular wing or flexible washer 116. As indicated schematically in FIGS. 9 and 10, when the handle 72, the attached probe 90 and the surmounting threaded bushing-like cap 50 are threadedly secured to the neck 38 of the bottle 20, the flexible and resilient annular wing 116 is brought into positive and fluid-sealing engagement with an inner top annular edge of the bottle neck 38, in fluid-sealing engagement therewith. Also, as indicated in FIG. 9, as the closure cap 50 is advanced further onto the threaded neck 38 of the container 20, the flange 76 against which the bushing-like cap 50 bears is urged downwardly to abut and stressingly to engage an upwardly directed annular edge 124 of the washer like wing 116 to limit the forced distortion thereof and to provide a second, auxiliary seal as well as to augment and enhance the primary seal established between the flexible wing 116 and the abutting edge 120 of the threaded neck 138.

It will be appreciated that in use of the container and wand-like applicator assembly, when the sleeve-like cap 50 is separated from the container neck 38, the cap 50, wand-like handle 66 and the depending applicator probe 90 are removed and manipulated as a stable, unitary assembly. During such applicator use, the container is conveniently positioned in its tilted or angular mode, as shown in FIG. 2.

It is contemplated that the container may conveniently be fabricated of a plastics material, and that plastics compositions may also be employed for the other component elements of the device of the invention. While preferred embodiments of the invention have been illustrated, other variations may be made utilizing the inventive concepts herein disclosed. It is intended that all such variations in functional structures and compositions be considered as within the scope of the invention as defined in the following claims.

What is claimed is:

1. A bottle-like container, probe-like applicator means insertable into said container for the use therewith, said container comprising a container body, an upwardly opening neck integrally formed with and surmounting said body at an upper end thereof, and a floor-like base integral with and bridging and closing said body at a lower extremity thereof, external thread means integrally formed on an exterior of said container for coupling a closure, thereto, said probe-like applicator means comprising a multi-component combination applicator and closure assembly including a bushing-like, internally-threaded cap for threadedly engaging said thread means on said neck of said container, said cap having an axially extending through passage therein and opening upwardly at a top portion of said cap, a handle including a manually-manipulable, wand-like shaft extending upwardly through said passage of said cap, said shaft defining at a base zone thereof a generally-cylindrical neck integrally formed with a radially-extending annular flange, said cap being sleeved over and contiguously and sealingly engaging said shaft and bearing downwardly upon said flange, said probe-like applicator means constituting means for insertion into said container for retrieval of a fluid composition retained in said container and including spreader means at a lower end of said applicator means for applying the composition to a surface to be coated, means for securing said applicator means to a said shaft of said handle, and said applicator means being integrally formed with radially outwardly directed flexible and resilient wing means, said wind means circumscribing said applicator means at an upper end zone thereof, said wing means overlying said neck of said container at an open end thereof for stressingly and resiliently abutting said neck of said container and for establishing a fluid-tight, ring-like resilient seal between said wing means and said neck of said container when said cap is surmounted on and is threadedly advanced downwardly about said neck of said container, said container being selectively tiltable and selectively positionable to assume each of two distinct and different stable angular attitudes including an upright storage mode and a different, tilted use mode, said container having a principal longitudinal axis paralleling and in line with a longitudinal axis of said neck, said base of said container being characterized in defining a container support including two intersecting sectors angled with respect to one another and extending in two corresponding intersecting planes, said base being further characterized in that a plane in which a first of said sectors lies extends normally of said principal longitudinal axis of said body of said container and normally of a longitudinal axis of said applicator means extending into said container coaxially with said principal longitudinal axis thereof to establish a first, stable, orientation stand-by mode of said container when said container rests on said first sector, and in that a second of said sectors is angularly oriented with respect to said principal longitudinal axis of said body of said container to maintain a center of gravity of said container at a locus overlying said second of said sectors when said container rests on said second of said sectors, to ensure that a use mode orientation configuration assumed by said container when in a tilt mode is a mechanically stable configuration.

2. The structure as set forth in claim 1 in which said second base sector defines a plane which extends upwardly at an angle of about 55° with respect to said principal longitudinal axis of said body of said container.

3. The structure as set forth in claim 1 and further comprising plug-like boss means projecting coaxially with and downwardly of said wand-like shaft as an extension thereof for coupling with said applicator means, and wherein said applicator means is formed at an upper end zone thereof with socket means coaxial with said applicator means and opening upwardly thereof for matingly receiving said boss means of said shaft coaxially therewithin, and cooperating interlock means carried by said boss means and formed in said socket means for coupling interengagement firmly to interlock said wand-like shaft with said applicator means, said interlock means comprising radially outwardly directed projections integral with said boss means, and cooperating, projection-receiving recesses preformed in walls bounding said socket means.

4. The structure as set forth in claim 1, wherein said wing means is in abutting engagement with to establish a fluid-impervious seal between an under surface of said wing means and an upper, radially inwardly disposed annular edge zone of said neck of said container.

5. The structure as set forth in claim 4, wherein said flange at a base zone of said wand-like shaft constitutes stop means for limiting upward pivotal distortional displacement of said wing means at radially outward extremities thereof, for stabilizing said wing means, and for establishing an auxiliary annular seal during forced sealing engagement of said wing means with said container at a mouth thereof.

6. The structure as set forth in claim 1, wherein said bushing-like cap is formed at an upper zone, interiorly thereof, with an annular shaft-engaging surface contoured in conformity with for contiguous abutment with said shaft and said flange thereof for fluid-impervious sealing engagement therewith.

7. A bottle-like container adapted for use with a hand-held, wand-like applicator and comprising a container body, an upwardly opening neck integrally formed with and surmounting said body at an upper end thereof, and a floor-like base integral with and bridging and closing said body at a lower extremity thereof, external thread means integrally formed on an exterior of said neck of said container for coupling a bottle closure thereto, a multi-component combination applicator and closure assembly for said container, said applicator and closure assembly including a bushing like internally threaded cap for threadedly engaging said threads on said neck of said container; said cap having an axially-extending through passage therein, and opening upwardly at a top portion of said cap, a handle including a manually-manipulable, wand-like shaft extending upwardly through said passage of said cap, said shaft defining at a base thereof a generally cylindrical neck integrally formed with a radially-extending, annular flange, said cap being sleeved over and contiguously sealingly engaging said shaft and bearing downwardly upon said flange, elongate probe-like applicator means for insertion into said container for retrieval of a fluid composition retained in said container and including spreader means at a lower end of said applicator means for applying the composition to a surface to be coated, and means for securing said applicator means to said shaft, said applicator means being integrally formed with radially outwardly directed flexible and resilient wing means, said wing means circumscribing said applicator means at an upper end zone thereof, said wing means overlying said neck of said container at an open end thereof for stressingly and resiliently abutting said neck of said container and for establishing a fluid-tight, ring-like, resilient seal between said wing means and said neck of said container when said cap is surmounted on and is threadedly advanced downwardly about said neck of said container.

* * * * *